US005542623A

United States Patent [19]

Garand et al.

[11] Patent Number: 5,542,623

[45] Date of Patent: Aug. 6, 1996

[54] METHOD AND APPARATUS FOR INSTALLING A MEDIA SUPPLY CASSETTE IN AN IMAGESETTER

[75] Inventors: Donald J. Garand, Chelmsford; Lawrence S. Blake, Peabody, both of Mass.

[73] Assignee: Bayer Corporation, Wilmington, Mass.

[21] Appl. No.: 309,812

[22] Filed: Sep. 21, 1994

[51] Int. Cl.[6] ..... B65H 19/12

[52] U.S. Cl. ..... 242/559.4; 414/911

[58] Field of Search ..... 242/557, 559, 242/559.4; 355/309, 311, 321; 414/911

[56] References Cited

U.S. PATENT DOCUMENTS

| | | | |
|---|---|---|---|
| 2,622,816 | 12/1952 | Koch | 242/559.4 |
| 3,880,372 | 4/1975 | Witte | 242/557 |
| 4,266,903 | 5/1981 | Surbrook | 414/911 |
| 4,593,883 | 6/1986 | Nelson | 414/911 |
| 4,679,743 | 7/1987 | Dallmaier | 242/559.4 |
| 5,134,915 | 8/1992 | Fukano et al. | 242/559.4 |
| 5,158,639 | 10/1992 | Washizaki | 414/911 |
| 5,246,180 | 9/1993 | Berry, III et al. | 242/559.4 |
| 5,421,691 | 6/1995 | Ferrone | 242/559.4 |

FOREIGN PATENT DOCUMENTS

| | | | |
|---|---|---|---|
| 1206332 | 2/1960 | France | 242/559.4 |

*Primary Examiner*—John P. Darling
*Attorney, Agent, or Firm*—Julie A. Krolikowski

[57] ABSTRACT

An assist mechanism for installing a web-type media supply into an imagesetter allows a single user to automatically lift and position a large format media supply cassette containing a supply roll from a reloading location remote from the imagesetter to a docking location in the imagesetter. The assist mechanism comprises a roll-up cart having a support bracket mounted on the top a telescopic column with two arms for supporting the supply cassette. The cart is positioned adjacent to the remote location at which time a foot switch on the cart is used to actuate the telescopic column to vertically raise and lower the support bracket. The bracket arms hook under the ends of a supply roll bearing supporting the supply roll, to lift the media supply from the surface. The cart is then rolled to the docking location of the imagesetter and the assist mechanism is actuated by the foot switch to vertically adjust the telescopic column supporting the support bracket. The media supply is then positioned into a support tray at the docking location. When the media supply is sitting in the tray, the bracket arms disengage from the end pins and the cart is rolled away. The media supply is then automatically positioned for use by the imagesetter, The assist mechanism is also be used to remove the cassette from the tray in a similar manner.

8 Claims, 9 Drawing Sheets

METHOD AND APPARATUS FOR INSTALLING A MEDIA SUPPLY CASSETTE IN AN IMAGESETTER

BACKGROUND OF THE INVENTION

The invention is related to media supply cassette handling, and more specifically to installation and removal of large format media supply rolls and supply cassettes used in imagesetters.

Imagesetters typically have a supply roll of photosensitive media in a light-safe supply cassette, a recording support surface, and an image scanning system for scanning an image onto the media. The media passes from the supply roll supported in the supply cassette, to the recording support surface where the photosensitive media is exposed by the image scanning system. The exposed media is transported in web form into a take-up cassette for storage in a light-safe environment. Otherwise, the media is transported by a conveyor directly from the imagesetter to a processor for developing. When the supply roll runs out or when the operator requires a different media type for imaging, the supply cassette is removed by the operator and reloaded with a new supply roll, or replaced by another media supply cassette containing the different media type.

Large format media supply cassettes are relatively bulky and heavy for manual manipulation as they are designed to support supply rolls ranging in width from 16 to 36 inches. Manual loading and installation of large format media into an imagesetter usually requires two operators. It is desirable to increase productivity with a supply cassette installation and removal system that is easy for a single operator to use.

It is accordingly an object of the present invention to assist an imagesetter operator with large format media supply cassette reloading, installation and removal.

It is another object of the present invention to allow a single operator to install and remove and a media supply cassette without requiring any manual lifting of the supply cassette by the operator.

It is yet another object of the present invention to allow a single operator to reload a media supply cassette by replacing the supply roll without removing the cassette from the imagesetter and without requiring any manual lifting of a supply roll by the operator.

SUMMARY OF THE INVENTION

A media supply installing apparatus is used with an imagesetter which has a docking location for holding a media supply in the form of a roll of image recording media, a media support surface for supporting media drawn out from the supply in the docking location, and an image scanning apparatus for scanning an image on the media on the media support surface. An automatic assist mechanism is used for assisting an operator with installation and removal of the media supply to and from the docking location in the imagesetter, with no manual lifting of the media supply by the operator. The assist mechanism is easily movable by the operator with respect to the imagesetter.

BRIEF DESCRIPTION OF THE DRAWINGS

The features and objects of the invention will become apparent in the following description taken with the accompanying drawings, in which.

DETAILED DESCRIPTION OF THE INVENTION

Figure 1:
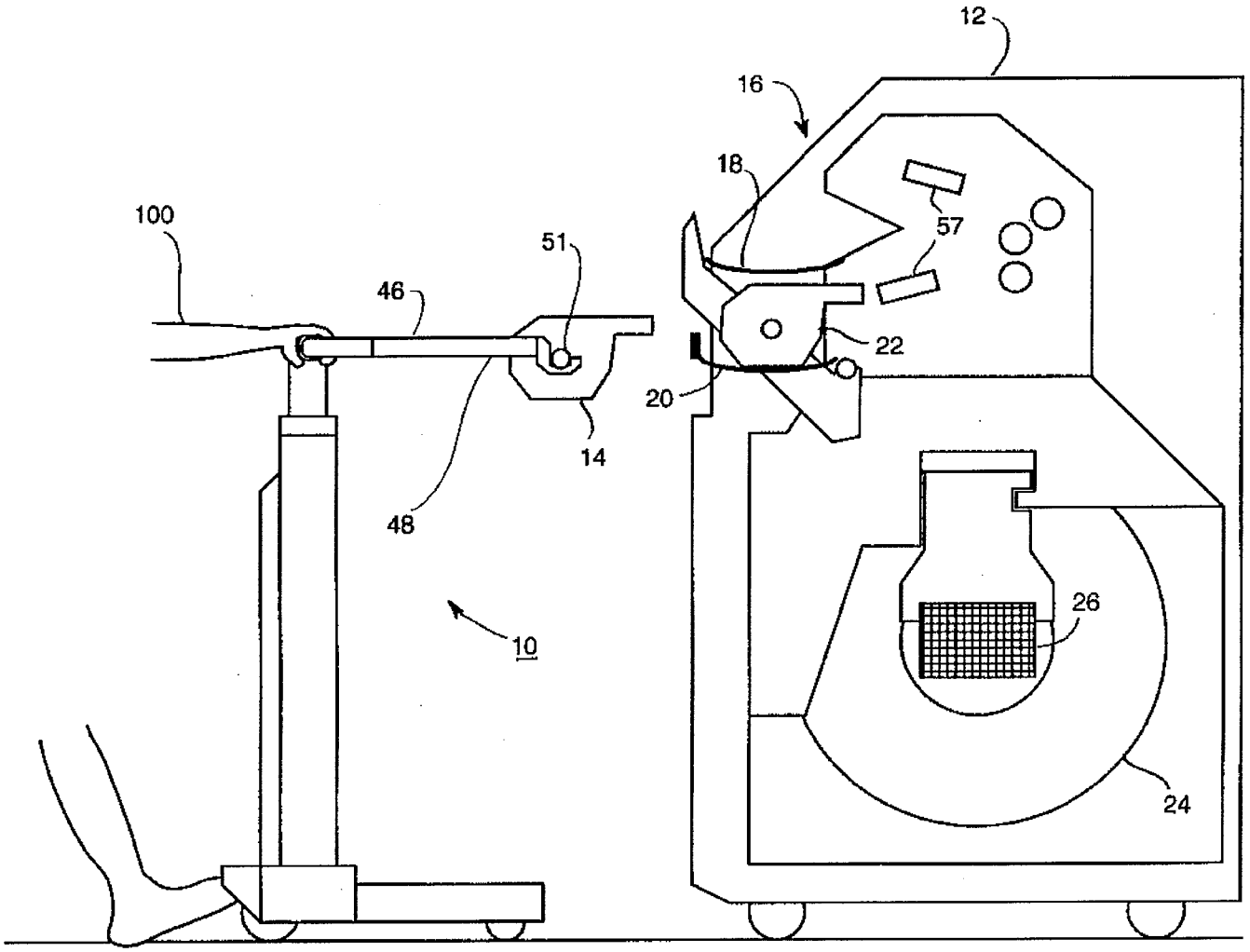
FIG. 1 is an illustrative view of a media supply assist mechanism installing a media supply cassette into an imagesetter according to the invention.

The assist mechanism shown in FIG. 1 is generally indicated by reference numeral 10. The assist mechanism 10 is adjacent to an imagesetter 12 and is shown supporting a media supply cassette 14 containing a roll of photographic media or other image recording material in web form. The imagesetter 12 has a docking area, generally indicated as 16, with two support trays, an upper tray 18 and a lower tray 20, for supporting two media supply cassettes 14, 22 respectively. The two support trays 18, 20 allow a user to select from the two different supply cassettes 14, 22 which can contain the same types of media, different types of media, or different widths or thicknesses of media. Additionally the supply cassette not in use can be reloaded or removed without interrupting the operation of the imagesetter for daylight loading media. A scanning support surface 24 is provided with a drum shape for supporting the media drawn out from either supply cassette 14, 22 supported in the docking area 16. An image scanning apparatus 26 scans an image with a modulated energy source (not shown) onto the media supported by the scanning support surface 24.

Figure 2A:
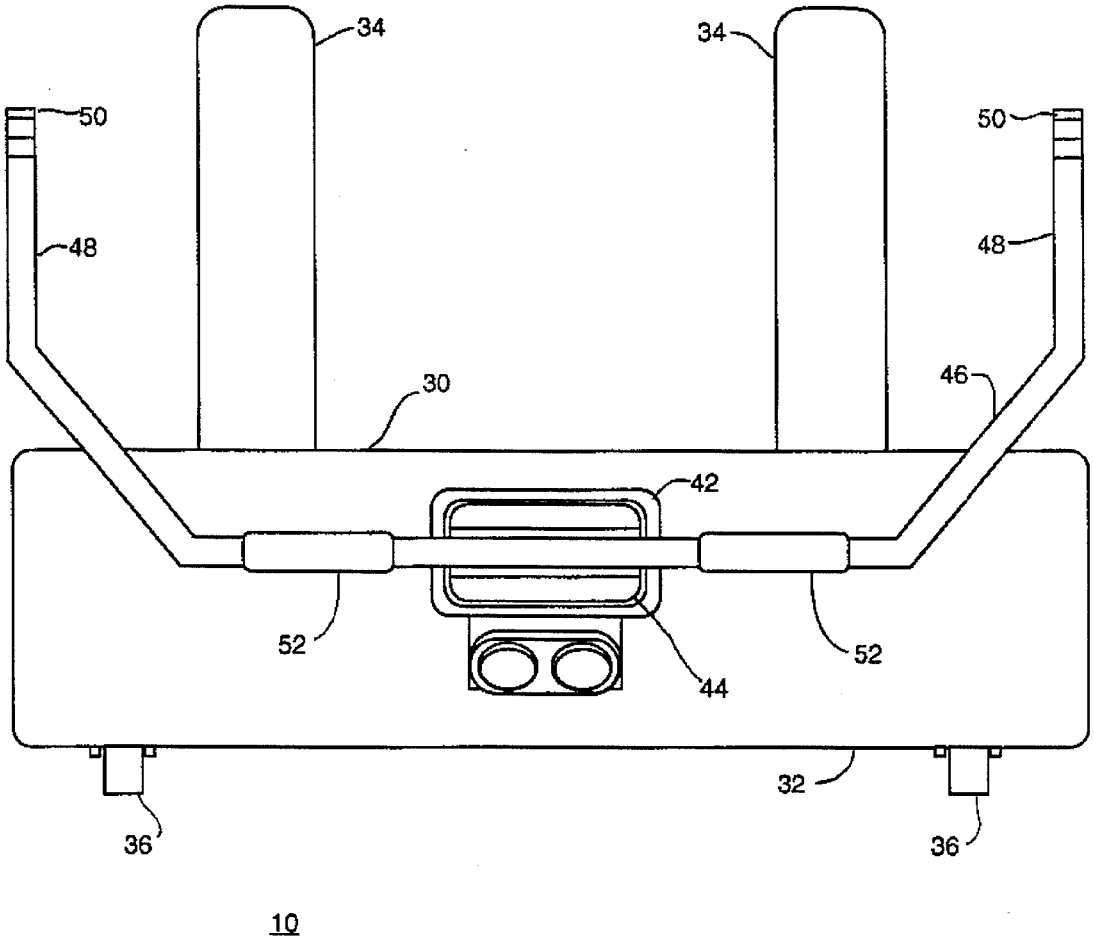
FIG. 2*a* is an schematic plan view of the media supply assist mechanism of FIG. 1 according to the invention.
Figure 2B:
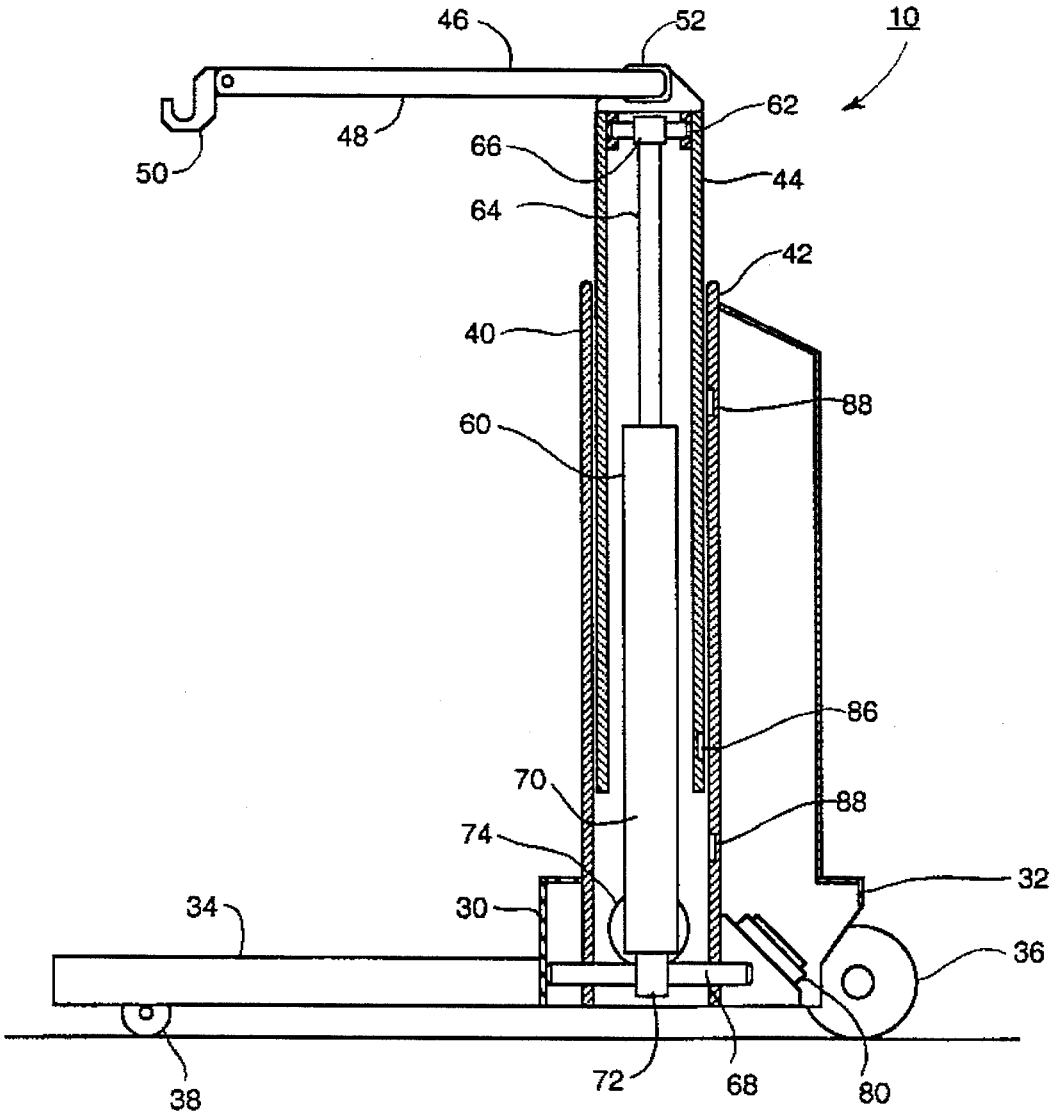
FIG. 2*b* is a partial-sectional side view of the media supply assist mechanism of FIG. 1 according to the invention.
Figure 2C:
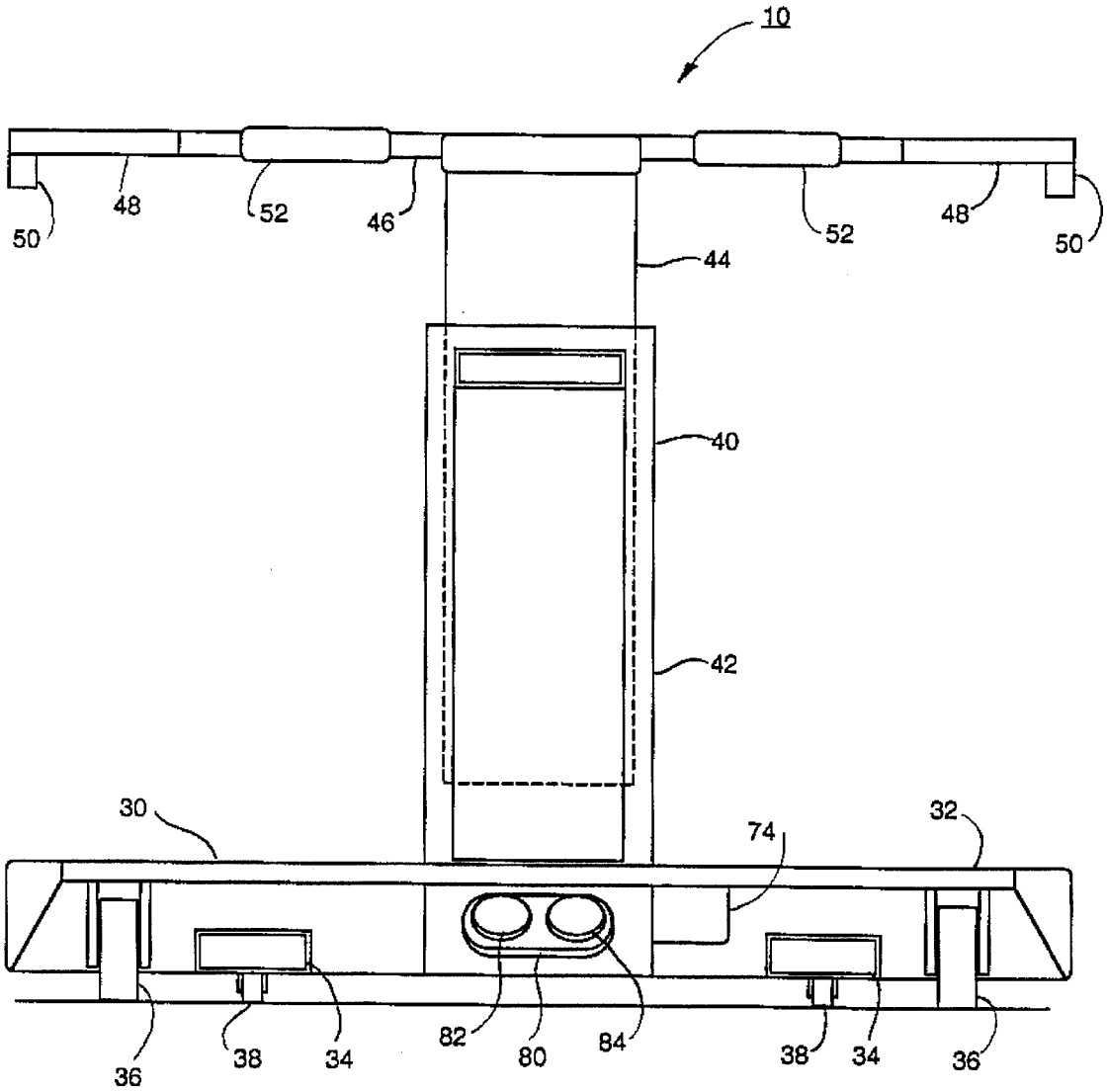
FIG. 2*c* is a schematic rear view of the media supply assist mechanism of FIG. 1 according to the invention.

Referring now to FIGS. 2*a*, 2*b*, and 2*c*, the construction of the assist mechanism will be described. The assist mechanism 10 has a generally U-shaped base weldment 30 as viewed in FIG. 2*a*, consisting of a rectangular member 32 with two widely spaced perpendicular legs 34 extending therefrom. The base weldment 30 is supported for movement on two rear wheels 36 mounted at the outer ends of the rectangular member 32 and two small front swivel wheels 38 on the leg ends to provide stability to the assist mechanism 10 while supporting and moving the supply cassette. A vertically upright support 40 has a hollow outer tube 42 fixed to the rectangular member 32 and an inner tube 44 telescopically mounted within the outer tube 42. A generally U-shaped bracket 46 is fixed to the top of the inner tube 44 at a middle portion of the U-shaped bracket 46. The bracket 46 has two arms 48 extending in same direction as the legs 34 of the base weldment 30. The arms 48 are provided with end hooks 50 to carry a supply roll or a supply cassette containing a supply roll (FIG. 1). Two handle grips 52 are provided on opposite sides of the upright support 40 for a user to grip the bracket 46 with during movement of the assist mechanism 10.

Referring to FIG. 2*b*, the upright support 40 is equipped with an actuator 60 to vertically raise and lower the inner tube 44 telescopically with respect to the outer tube 42. A horizontal top pin 62 is attached inside the top of the inner tube 44 and is coupled to a translating tube 64 of the actuator 60 through a first clevis end 66. A horizontal bottom pin 68 is attached inside the bottom of the outer tube 42 and is coupled to a fixed tube 70 of the actuator 60 through a second clevis end 72. The translating tube 64 is telescopic with respect to the fixed tube 70. The actuator 60 is driven by an attached D.C. motor 74 which rotates a screw inside the fixed tube 70 through conventional gearing, causing linear movement of a traveling nut secured to the inside of the translating tube 64 (not shown). The operation of the actuator 60 is not unique to the present invention and is considered to be known in the art. Such actuators are available from DUFF-NORTON® as for example MINI-PAC™ Actuators, 6405 series.

The D.C. motor 74 of the actuator 60 is controlled by a foot switch 80 which has two pedals 82, 84, shown in FIG. 2*c*. A first pedal drives the motor in a first direction corresponding to raising the translating tube 64 of the actuator 60 and the attached inner tube 44 of the upright support 40, causing the bracket 46 to be raised with the movement of the telescopic inner tube 44. A second pedal drives the motor 74 in an opposite direction corresponding to lowering the translating tube 64 and the attached inner tube 44 of the upright support 40, causing the bracket 46 to be lowered with the movement of the inner tube 44. Limit switches 86, 88 are located on the inner and outer tubes 44, 42 respectively, to signal the actuator motor 74 to shut off when the telescopic inner tube 44 reaches its upper and lower vertical limits.

Figure 3:
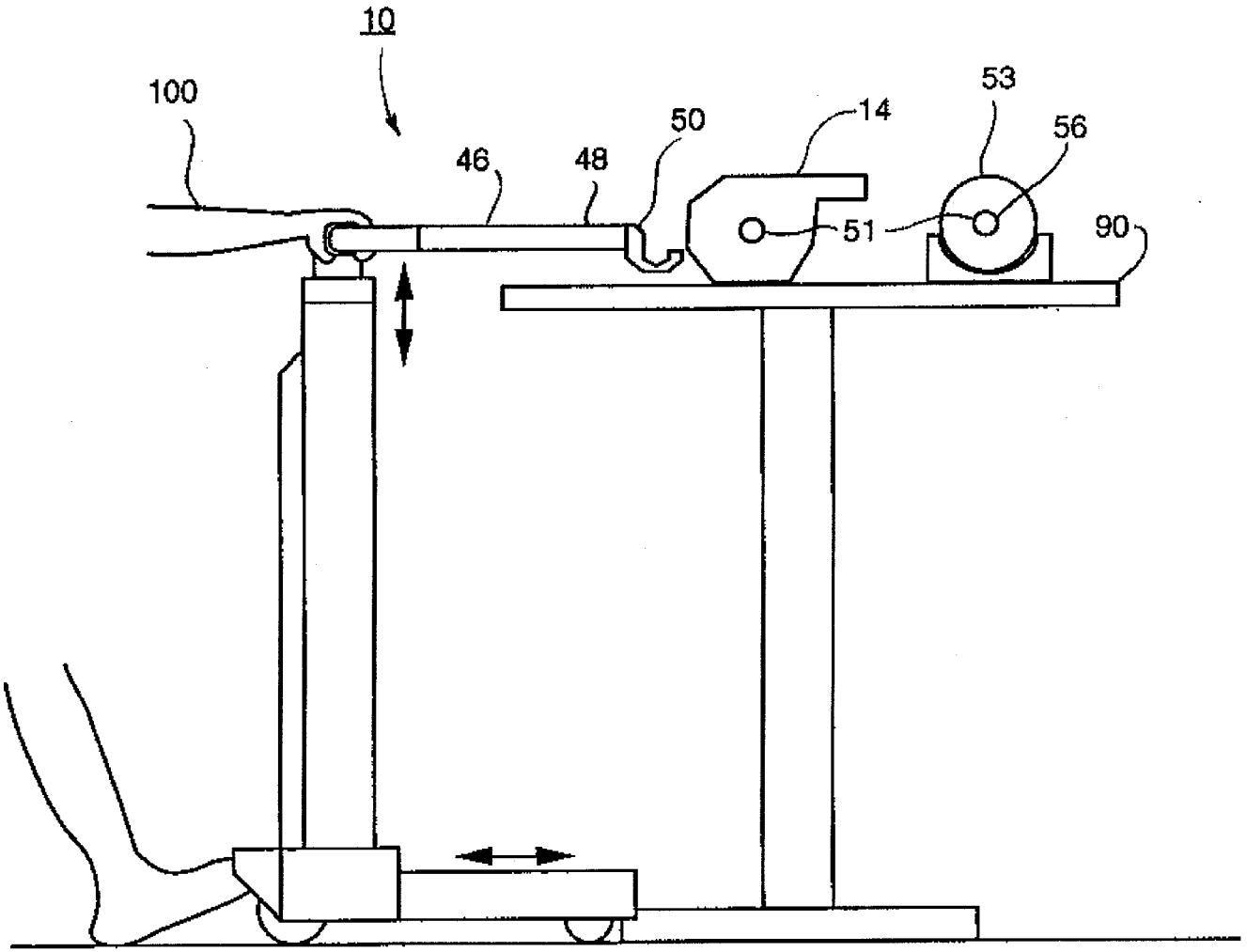
FIG. 3 is an illustrative view of a step of the operation of the assist mechanism according to the invention.

The assist mechanism is generally used to install or remove a supply cassette from the supply cassette docking area in the imagesetter. When a supply cassette requires reloading with a new supply roll, the operator can manually remove the relatively light empty supply cassette and then reload it with a new supply roll at a remote work surface. In FIG. 3 it is shown that a supply roll 53 is mounted on a supply roll bearing 51 which passes through the core 56 of the supply roll 53 and protrudes from the ends of the supply cassette when the supply roll 53 is contained within the supply cassette. The roll bearing ends 51 allow the supply roll 53 to be handled without the user's hands touching the media. It is advantageous to reduce direct handling of the media by the user as some media is sensitive to finger and hand prints. The bearing ends 51 also support the supply roll 53 for unwinding of the media from the supply roll during use, and cooperate with grooved mounting brackets 57 (FIG. 1) to guide the supply cassette into the docked position.

Figure 4:
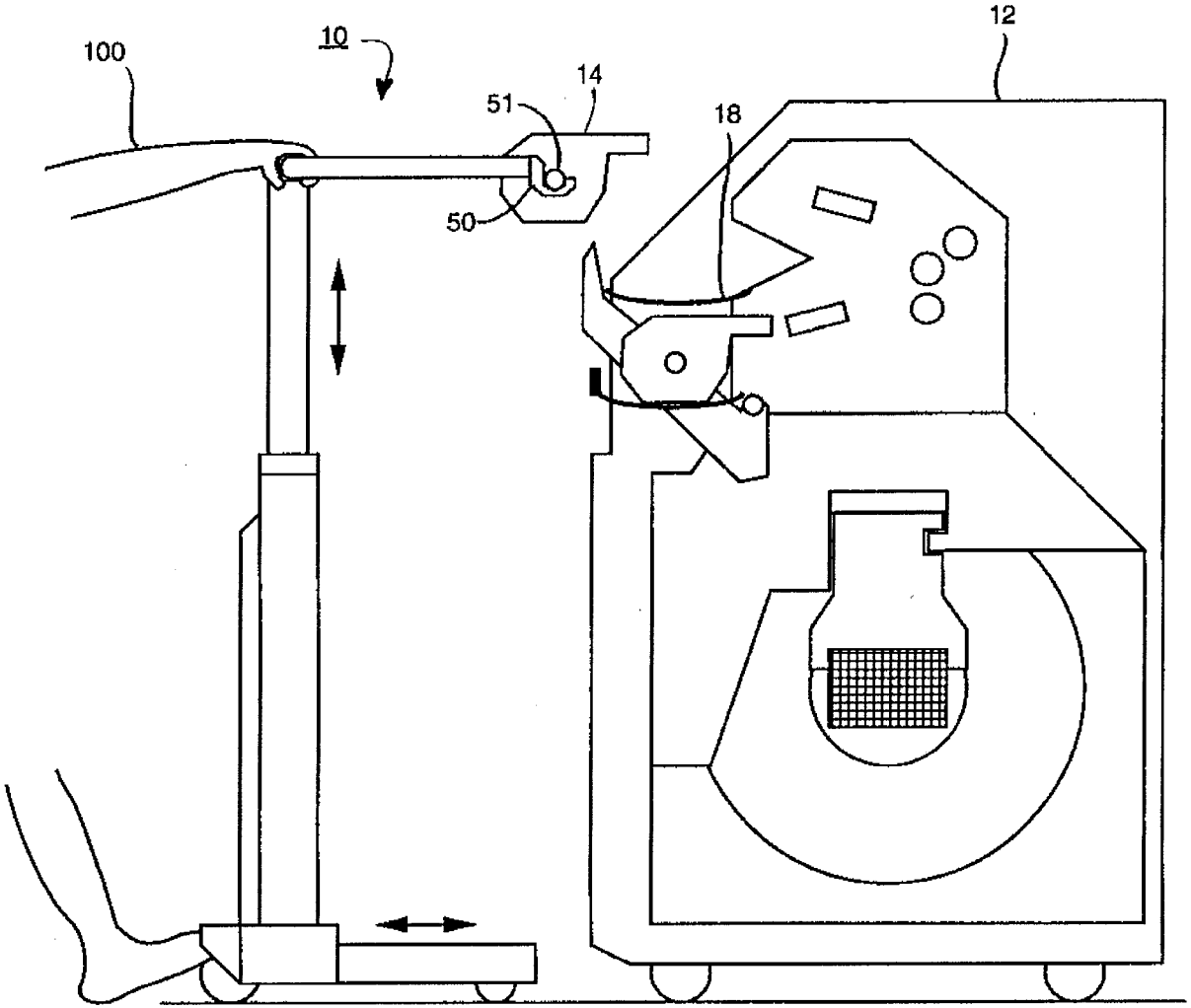
FIG. 4 is an illustrative view of a step in the operation of the assist mechanism according to the invention.
Figure 5:
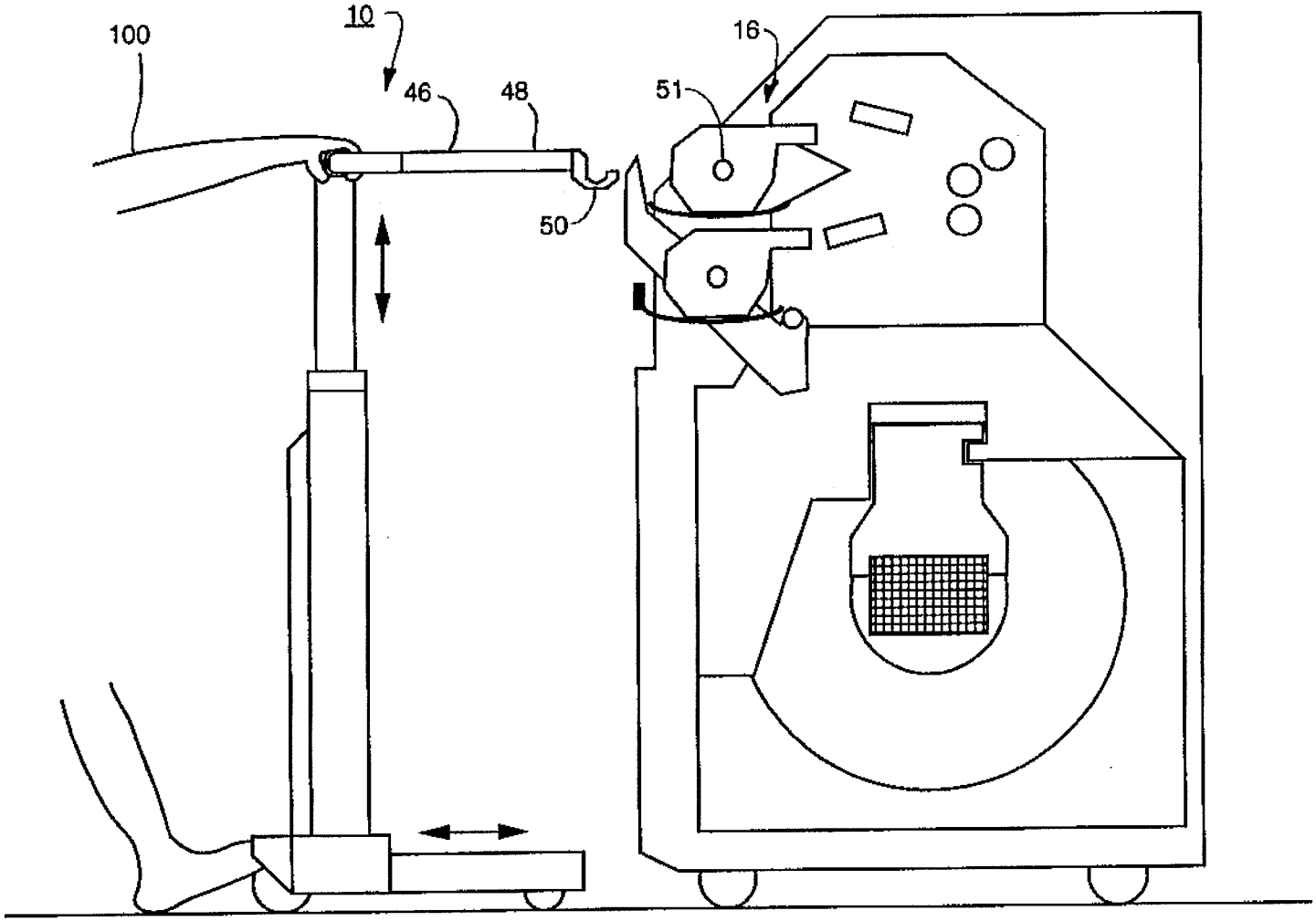
FIG. 5 is an illustrative view of a step in the operation of the assist mechanism according to the invention.
Figure 6:
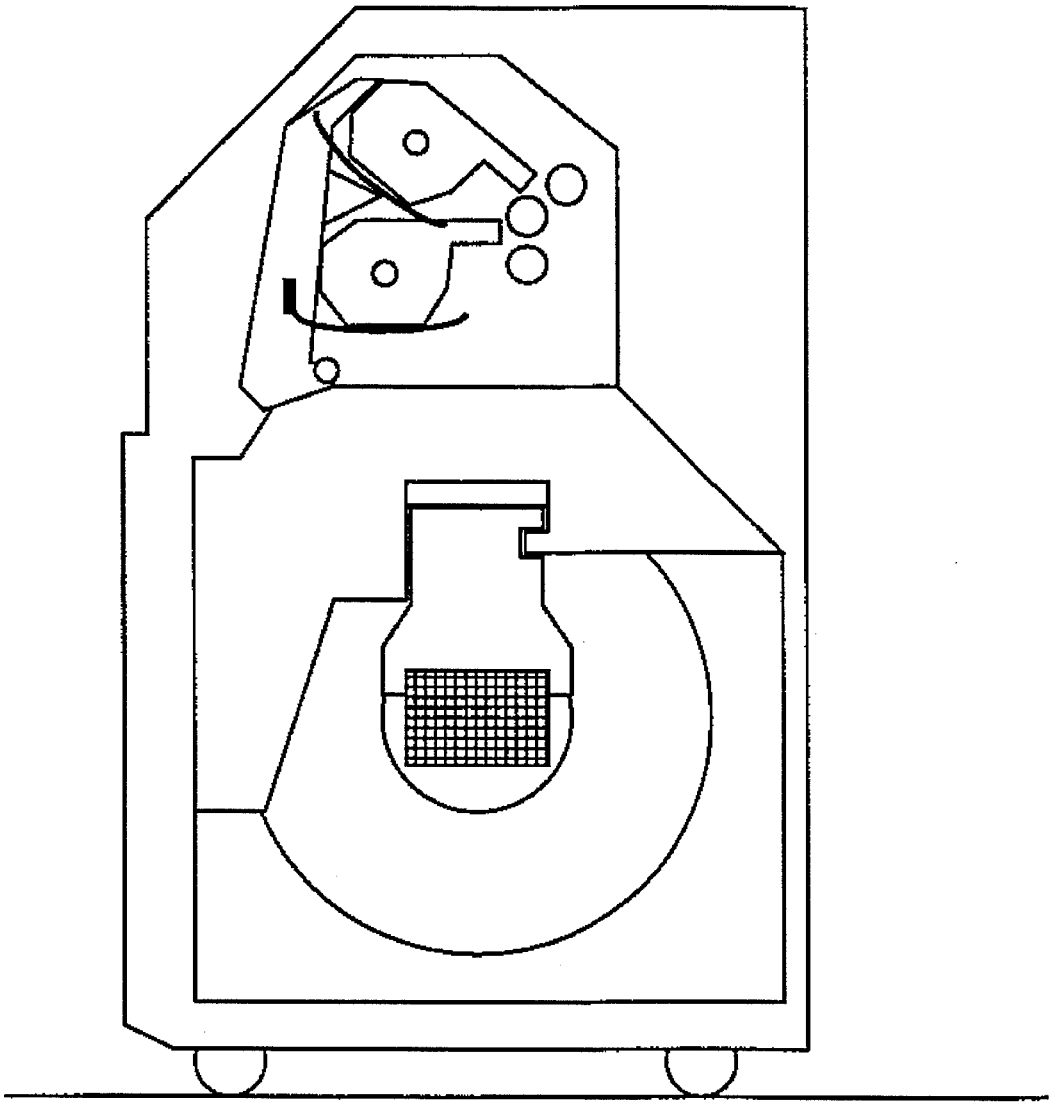
FIG. 6 is an illustrative view of an imagesetter having installed media supply cassettes.

To install the reloaded supply cassette, the operator uses the assist mechanism to lift the heavy reloaded supply cassette from the work surface and place it in the imagesetter. Referring to FIG. 3, the assist mechanism 10 is rolled to the work surface 90 by an operator 100 and the bracket 46 is aligned with the supply cassette 14. The operator 100 then uses the foot switch to raise or lower the bracket 46 to position the arms 48 at a height between the work surface 90 and the ends of the roll bearing 51 extending through the supply cassette 14, located at about mid-height on the supply cassette 14. The assist mechanism 10 is then manually maneuvered by the operator 100 so that the end hooks 50 on the arms 48 of the bracket 46 are positioned underneath the bearing ends 51 of the supply cassette 14. The operator 100 then uses the foot switch to raise the bracket 46 so that the ends of the roll bearing 51 are engaged by the end hooks 50 to cradle the supply cassette 14 in the arms 48 of the assist mechanism 10 and lift the supply cassette 14 from the work surface 90. Referring to FIG. 1, the assist mechanism 10 is then rolled by the operator 100 to be adjacent to the imagesetter's supply cassette docking area 16. In FIGS. 4 and 5, the operator uses the foot switch to vertically raise or lower the bracket 46 to a height above the desired support tray 18 for the supply cassette 14, which is pulled out from the docked position to an access position. Then the foot switch is used by the operator 100 to lower the supply cassette 14 into the selected support tray 18. Once the supply cassette 14 is resting in the support tray 18, the bracket is lowered slightly to unhook the bracket end hooks 50 from the roll bearing 51. Then the assist mechanism is rolled away by the operator as in FIG. 5, clearing the arms 48 of the bracket 46 from the docking area 16. A latching mechanism on the support tray (not shown) cooperates with a pin on each end of the supply cassette (not shown), to secure the supply cassette in a fixed relationship with respect to the support tray. The operator manually locks the supply cassette into the support tray and positions the support tray into the docked location. FIG. 6 shows the support trays 18, 20 both in the docked position. Once the supply cassette is in the docked location the imagesetter automatically positions the media for use so the imagesetter can draw upon the media supply when needed.

Figure 7:
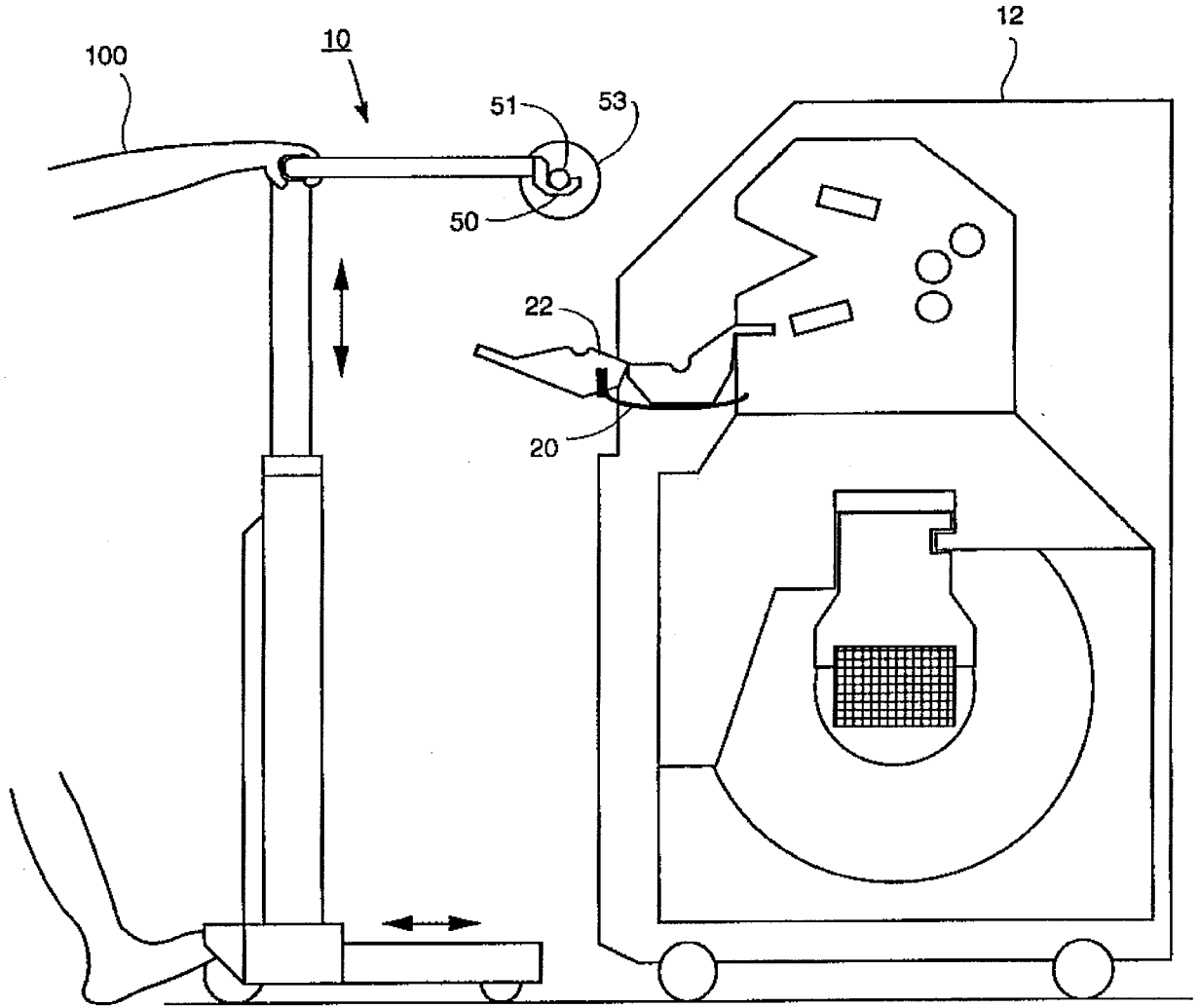
FIG. 7 is an illustrative view of a step in the operation of the assist mechanism according to the invention.

The assist mechanism is also useful for removing a supply cassette from a support tray in the imagesetter when the operator wishes to change types of media, in which case the installed supply roll need not be empty. The supply roll being removed can be a relatively new roll and therefore will be heavy and difficult for a single operator to handle, particularly if large format media is being handled. Further, if the operator wishes to reload the supply cassette and replace the supply roll without removing the supply cassette from the support tray, the supply roll is removed in the following manner. Referring to FIG. 7, the supply cassette requiring supply roll replacement is moved by the operator from the docked position to the access position. The supply cassette 22 has a hinged flip cover which accommodates the bearing ends 51 extending past the ends of the supply cassette 22. The cassette cover is flipped opened, exposing the supply roll to be removed from the cassette. The assist mechanism 10 is then rolled by the operator 100 to the supply roll 53 such that the end hooks 50 are positioned at the ends of the roll bearing 51 extending through the supply cassette casing 22. The operator 100 then uses the foot switch to vertically raise the supply roll 53 by the bearing ends 51, out of the supply cassette 22, while the supply cassette 22 remains in the support tray 20 due to the latching mechanism (not shown). The foot switch is released to stop the assist mechanism, and then the assist mechanism 10 is rolled to a remote location such as a work surface 90 shown in FIG. 3. The supply roll 53 is then lowered down to the work surface 90 by use of the foot switch, and the roll bearing ends 51 are released from the end hooks 50 as the arms 48 of the bracket 46 are lowered. The roll bearing 51 is then removed from the core of the supply roll 53 and is inserted into the core of the replacement supply roll, or alternatively each supply roll may be equipped with an individual roll bearing. The replacement supply roll may then be lifted by the roll bearing ends 51 with the assist mechanism 10 in a manner similar to that previously described for installing the supply cassette 14 into the support tray 20, however the supply cassette is mounted in the support tray rather than enclosing the supply roll. The supply roll 52 is moved from the work surface 90 with the assist mechanism 10, with no manual lifting required by the operator 100, and placed into the open supply cassette 14 in the support tray 20 of the imagesetter 12. The cover of the supply cassette 14 is then closed and the tray 20 is moved from the access position shown in FIG. 7 to the docked position shown in FIG. 6.

While this invention has been described in terms of a preferred embodiment, those skilled in the art will appreciate that various modifications, substitutions, omissions and changes may be made without departing from the spirit thereof. Accordingly, it is intended that the scope of the present invention be limited solely by the scope of the following claims, including equivalents thereof.

What we claim and desire to secure by Letters of Patent of the United States are the following:

1. An apparatus for handling and imaging media comprising:

a. an imagesetter including:

i) at least one docking location for holding a media supply;

ii) a media support surface for supporting media drawn from said media supply; and iii) an image scanning means for scanning an image onto said media supported on said media support surface; and b. assist means for assisting an operator during movement of said media supply relative to said docking location without requiring manual lifting of said media supply by said operator, said assist means including:

i) a plurality of nested, telescoping sleeves which share a substantially-vertical central axis, said plurality of nested sleeves having an innermost sleeve;

ii) a media supply grasping portion fixed at a predetermined angle to an upper surface of said innermost sleeve, said media supply grasping portion comprising:

a) a generally U-shaped bracket having a pair of distal ends; and b) a hook at each of said distal ends for securely engaging said media supply, through entire range of motion of said assist means; and iii) movement means for moving said assist means with respect to said imagesetter.

2. The apparatus of claim 1, wherein said predetermined angle is substantially 90°.

3. The apparatus of claim 1, further including a media cassette for containing said media supply.

4. A media supply installing and imaging apparatus comprising:

an imagesetter having at least two docking locations for holding a web-type media supply in the form of a roll of image recording media, a media support surface for supporting media drawn from a roll of media in one of the docking locations, and an image scanning apparatus for scanning an image onto the media on the media support surface; and assist means for assisting an operator with installation and removal of the media supply to and from said at least two docking locations in said imagesetter without requiring manual lifting of the media supply by the operator, said assist means having moving means for moving said assist means relative to said imagesetter independently in a horizontal direction and independently in a vertical direction.

5. The apparatus according to claim 4 wherein said media support surface is a cylindrical drum shape and said media is supported on an inside surface of the drum.

6. The apparatus according to claim 4, wherein said moving means comprises a vertically adjustable member which supports said media supply, said vertically adjustable member comprises at least two vertical telescopic members mounted telescopically relative to each other and wherein one of the telescopic members is automatically actuated by an actuator means to effect a vertical movement only of the media supply supported by said vertically adjustable member.

7. The apparatus according to claim 4, wherein a roll of image recording media has a width in a range of 16 to 36 inches and said at least two docking locations accommodate rolls of widths within said range, and wherein said assist means requires no physical adjustment when installing and removing rolls of media with widths in said range of 16 to 36 inches, into and out of said at least two docking locations in said imagesetter.

8. The apparatus according to claim 4, wherein said at least two docking locations in said imagesetter have different vertical heights relative to one another.

* * * * *